US007435053B2

(12) United States Patent
Liang

(10) Patent No.: US 7,435,053 B2
(45) Date of Patent: Oct. 14, 2008

(54) TURBINE BLADE COOLING SYSTEM HAVING MULTIPLE SERPENTINE TRAILING EDGE COOLING CHANNELS

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 598 days.

(21) Appl. No.: 11/092,776

(22) Filed: Mar. 29, 2005

(65) Prior Publication Data

US 2006/0222493 A1 Oct. 5, 2006

(51) Int. Cl.
*F01D 5/18* (2006.01)

(52) U.S. Cl. ..... 416/97 R

(58) Field of Classification Search ..... 416/96 R, 416/97 R; 415/115
See application file for complete search history.

(56) References Cited

U.S. PATENT DOCUMENTS

| | | | |
|---|---|---|---|
| 4,180,373 | A | 12/1979 | Moore et al. |
| 4,462,754 | A | 7/1984 | Schofield |
| 5,387,085 | A | 2/1995 | Thomas, Jr, et al. |
| 5,395,212 | A | 3/1995 | Anzai et al. |
| 5,488,825 | A | 2/1996 | Davis et al. |
| 5,591,007 | A | 1/1997 | Lee et al. |
| 5,857,837 | A | 1/1999 | Zelesky et al. |
| 5,873,695 | A | 2/1999 | Takeishi et al. |
| 5,967,752 | A | 10/1999 | Lee et al. |
| 5,971,708 | A | 10/1999 | Lee |
| 5,997,251 | A | 12/1999 | Lee |
| 6,079,946 | A | 6/2000 | Suenaga et al. |
| 6,099,252 | A | 8/2000 | Manning et al. |
| 6,139,269 | A | 10/2000 | Liang |
| 6,220,817 | B1 | 4/2001 | Durgin et al. |
| 6,227,804 | B1 | 5/2001 | Koga et al. |
| 6,264,426 | B1 | 7/2001 | Fukuno et al. |
| 6,331,098 | B1 | 12/2001 | Lee |
| 6,481,967 | B2 | 11/2002 | Tomita et al. |
| 6,508,620 | B2 | 1/2003 | Sreekanth et al. |
| 6,607,356 | B2 | 8/2003 | Manning et al. |
| 2002/0119045 | A1 | 8/2002 | Starkweather |

*Primary Examiner*—Edward Look
*Assistant Examiner*—Nathaniel Wiehe

(57) ABSTRACT

A cooling system for a turbine blade of a turbine engine having multiple serpentine trailing edge cooling channels in parallel. The serpentine cooling channels are positioned proximate to a trailing edge of the turbine blade and facilitate increased heat removal with less cooling fluid flow, thereby resulting in increased cooling system efficiency.

20 Claims, 5 Drawing Sheets

TURBINE BLADE COOLING SYSTEM HAVING MULTIPLE SERPENTINE TRAILING EDGE COOLING CHANNELS

FIELD OF THE INVENTION

This invention is directed generally to turbine blades, and more particularly to cooling systems in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots.

Localized hot spots, depending on their location, can reduce the useful life of a turbine blade and can damage a turbine blade to an extent necessitating replacement of the blade. Often, conventional turbine blades develop hot spots in the trailing edge of the blade. While the trailing edge of the turbine blade is not exposed to as harsh of conditions as a leading edge of the blade, the trailing edge requires cooling nonetheless. Many conventional cooling systems in the trailing edge of a turbine blade consist of a plurality of pin fins for increasing the cooling capabilities of the cooling system. Most pin fin cooling systems lack control of the cooling fluid flow through the trailing edge. Instead, the cooling fluids flow with relatively little boundaries. The lack of control of cooling fluid flow necessitates increased cooling fluid flow to insure that all portions of a trailing edge be adequately cooled. Such increased cooling fluid flow negatively affects the efficiency of the turbine blade cooling system. Thus, a need exists for a more efficient trailing edge cooling system.

SUMMARY OF THE INVENTION

This invention relates to a turbine blade cooling system formed from at least one cooling fluid cavity extending into an elongated blade and two or more serpentine trailing edge cooling channels in parallel with each other in the trailing edge of the turbine blade and in communication with the at least one cooling fluid cavity. The serpentine cooling channels in parallel increase heat reduction in the trailing edge region of the blade and reduce the amount of cooling fluid flow needed in the trailing edge region, thereby increasing the efficiency of the turbine blade cooling system.

The turbine blade may be formed from a generally elongated blade having a leading edge, a trailing edge, a tip section at a first end, a root coupled to the blade at an end generally opposite the first end for supporting the blade and for coupling the blade to a disc, and at least one cavity forming a cooling system in the blade. Two or more serpentine trailing edge cooling channels may be positioned in parallel proximate to the trailing edge of the turbine blade. In at least one embodiment, the turbine blade may include at least one first serpentine trailing edge cooling channel and at least one second serpentine trailing edge cooling channel that are each formed by at least three pass channels positioned in parallel and proximate to the trailing edge of the generally elongated blade for receiving cooling fluids from a cooling fluid source, passing the cooling fluids through the at least one first and second serpentine trailing edge cooling channels, and exhausting the cooling fluids through the trailing edge of the blade. The cooling system is not limited to only having two serpentine trailing edge cooling channels. Rather, the cooling system may have two or more serpentine trailing edge cooling channels, and may include third or fourth serpentine trailing edge cooling channels, or both. The serpentine trailing edge cooling channels may be at least triple pass channels, and in at least one embodiment, may be five pass channels, or a combination of triple and five pass channels.

The serpentine trailing edge cooling channels may include inlets that are generally orthogonal to a longitudinal axis of a cooling fluid supply channel. The inlets are aligned to facilitate flow of cooling fluids into the serpentine trailing edge cooling channels. The serpentine cooling channels may also include a plurality of trailing edge exhaust orifices for exhausting cooling fluids from the trailing edge of the turbine blade.

During use, cooling fluids are passed from the root of the blade into one or more cooling fluid cavities in the turbine blade. At least a portion of the cooling fluids, which may be air, is passed into a cooling fluid supply channel. These cooling fluids flow into the serpentine trailing edge cooling channels, where the cooling fluids remove heat from the material forming the turbine blade. Having multiple serpentine cooling channels positioned in parallel and in close proximity to the trailing edge of the blade is beneficial for a number of reasons. For instance, the multiple serpentine cooling channels increase heat removal from the trailing edge of the blade relative to conventional configurations. In addition, the multiple serpentine cooling channels requires less cooling fluid flow than conventional cooling systems, thereby improving the efficiency of the turbine engine.

An advantage of this invention is that each individual serpentine cooling channel is a modular formation enabling each to be customized. The modular formation provides flexibility in tailoring the airfoil trailing edge cooling scheme based on the airfoil gas side hot gas temperature and hot gas pressure distribution in both chordwise and spanwise directions.

Another advantage of this invention is that the modular configuration of the trailing edge cooling channels provides flexibility to achieve a desirable blade sectional average metal temperature for a given blade material based on the allowable blade stress level.

Yet another advantage of this invention is that the modular configuration of the trailing edge cooling channels provides a fail safe mechanism for trailing edge in the event of burn through or erosion at the airfoil trailing edge. The individual serpentine channels forming the modules may prevent trailing edge cooling air over flow, which minimizes the possibility for hot gas ingestion at the other trailing edge serpentine cooling channels. Additionally, if an individual serpentine cooling channel has eroded, the eroded channel will not affect the remaining serpentine trailing edge cooling channels, thereby yielding a robust cooling design.

Another advantage of this invention is that the serpentine cooling channel configuration incurs higher cooling fluid pressure than conventional pin fin trailing edge cooling systems, thereby yielding a more efficient cooling system because the internal pressure across an airfoil is typically very high.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
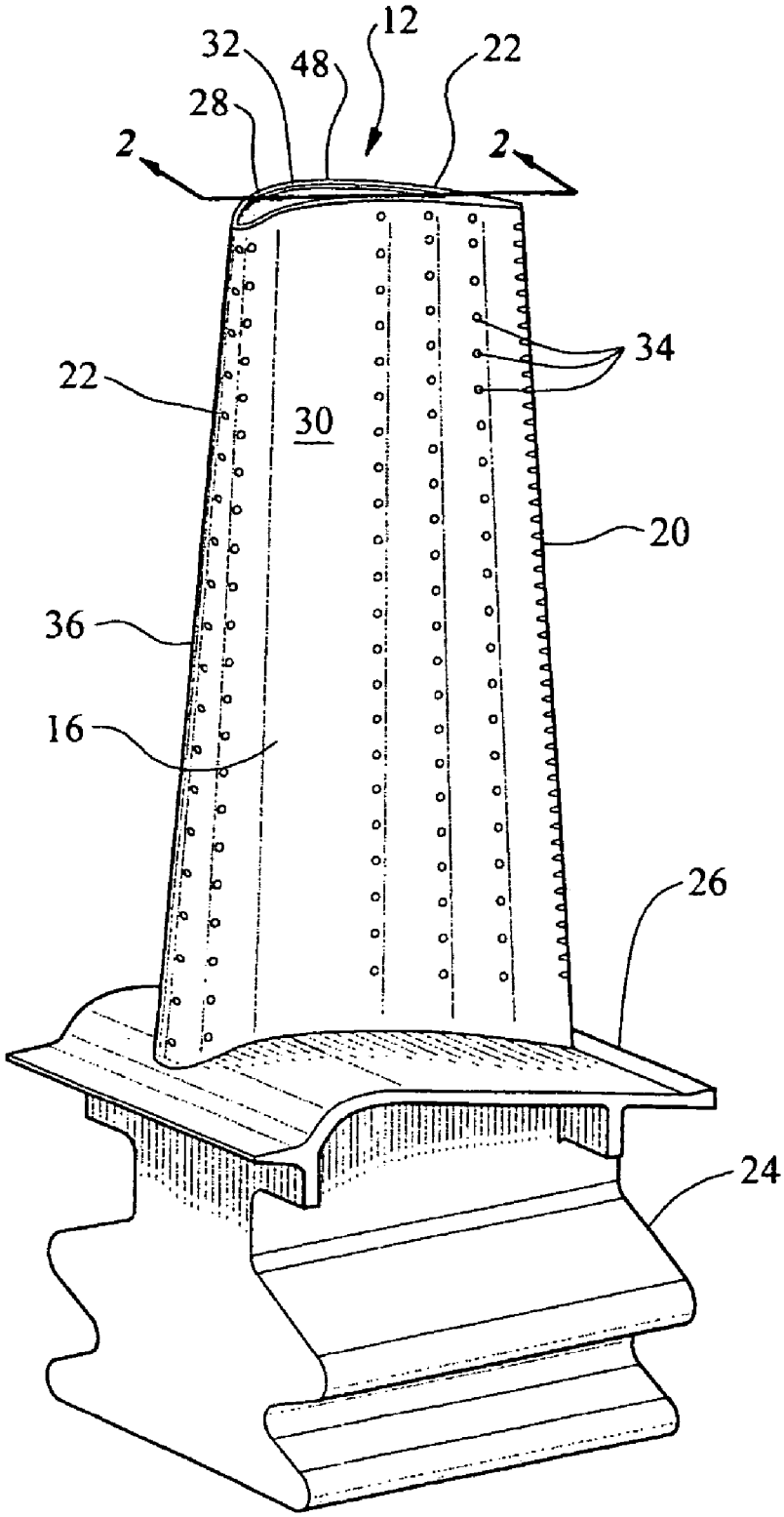
FIG. 1 is a perspective view of a turbine blade having features according to the instant invention.
Figure 2:
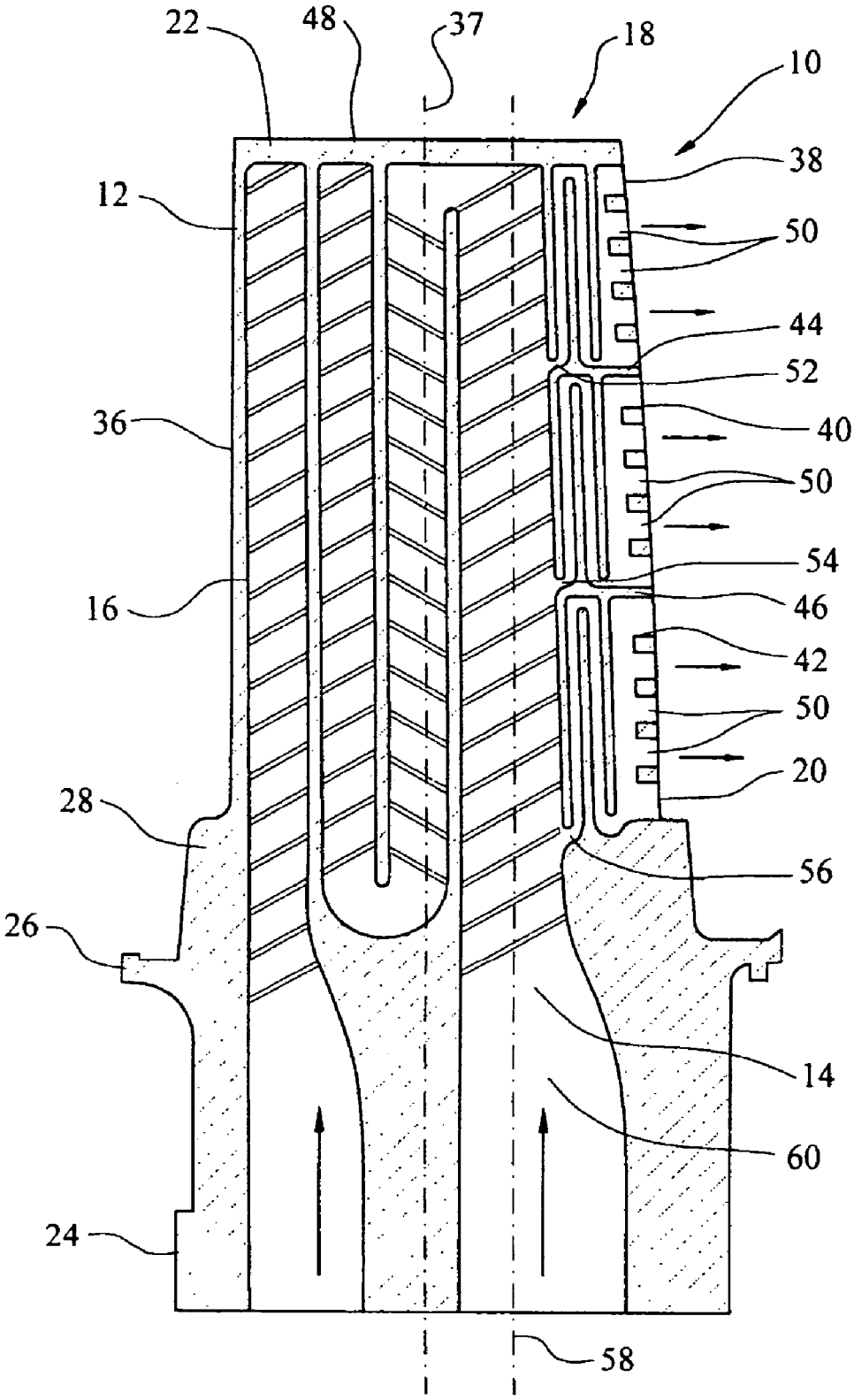
FIG. 2 is cross-sectional view, referred to as a filleted view, of the turbine blade shown in FIG. 1 taken along line 2-2.
Figure 3:
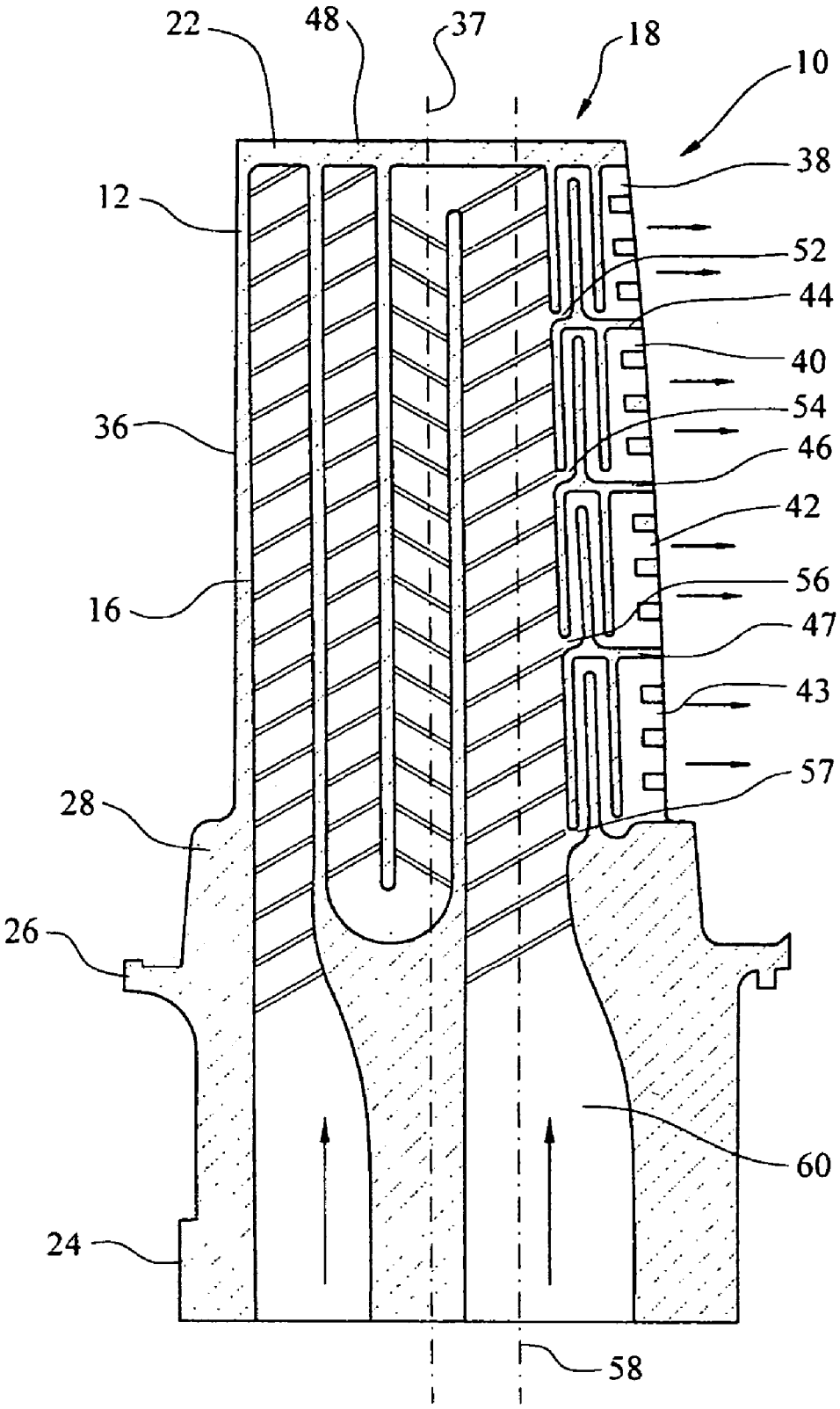
FIG. 3 is cross-sectional view, of an alternative embodiment of the turbine blade shown in FIG. 1 taken from the same perspective as line 2-2.

As shown in FIGS. 1-5, this invention is directed to a turbine blade cooling system 10 for turbine blades 12 used in turbine engines. In particular, the turbine blade cooling system 10 is directed to a cooling system 10 located in a cavity 14, as shown in FIGS. 2 and 3, positioned between two or more walls 28 forming a housing 16 of the turbine blade 12. The cooling system 10 may include two or more serpentine trailing edge cooling channels 18 positioned in parallel with each other in the cooling system, as shown in FIGS. 2-5, and in close proximity to a trailing edge 20 of the blade 12 for increasing the heat removal from the blade 12 and reducing the required cooling fluid flow to achieve adequate cooling, thereby increasing the effectiveness of the cooling system 10.

As shown in FIG. 1, the turbine blade 12 may be formed from a generally elongated blade 22 coupled to a root 24 at a platform 26. Blade 22 may have an outer wall 28 adapted for use, for example, in a first stage of an axial flow turbine engine. Outer wall 28 may form a generally concave shaped portion forming pressure side 30 and may form a generally convex shaped portion forming suction side 32. The cavity 14, as shown in FIGS. 2 and 3, may be positioned in inner aspects of the blade 22 for directing one or more gases, which may include air received from a compressor (not shown), through the blade 22 and out one or more orifices 34 in the blade 22 to reduce the temperature of the blade 22. As shown in FIG. 1, the orifices 34 may be positioned in a leading edge 36, tip 48, or outer wall 28, or any combination thereof, and have various configurations. The cavity 14 may be arranged in various configurations and is not limited to a particular flow path.

The cooling system 10, as shown in FIGS. 2 and 3, may also include serpentine trailing edge cooling channels 18 for removing heat from the blade 22 proximate to the trailing edge 20. In at least one embodiment, the cooling system 10 may include two or more serpentine trailing edge cooling channels 18. The serpentine cooling channels 18 may extend generally parallel to a longitudinal axis 37 of the elongated blade 22. As shown in FIG. 2, the cooling system 10 may include a first serpentine trailing edge cooling channel 38, a second serpentine trailing edge cooling channel 40, and a third serpentine trailing edge cooling channel 42. In another embodiment, as shown in FIG. 3, the cooling system 10 may include a fourth serpentine trailing edge cooling channel 43 in addition to channels 39, 40, and 42. The first and second serpentine trailing edge cooling channels 38, 40 may be separated from each other by a rib 44. The second and third serpentine trailing edge cooling channels 40, 42 may be separated from each other by a rib 46. The third and fourth serpentine trailing edge cooling channels 42, 43 may be separated from each other by a rib 47. As shown in FIG. 2, the first serpentine trailing edge cooling channel 38 may be positioned proximate to a tip 48 of the blade 22, and the third serpentine trailing edge cooling channel 42 may be positioned proximate to the root 24 of the blade 22. The first, second, third and fourth serpentine trailing edge cooling channels 38, 40, 42 and 43 may be positioned in close proximity to the trailing edge 20 of the blade 22 so that cooling fluids flowing through the channels 38, 40, 42 and 43 may remove heat from the blade 22 proximate to the trailing edge 20. The first, second, third, and fourth serpentine trailing edge cooling channels 38, 40, 42 and 43 may be positioned in parallel in the cooling fluid flow pattern.

The first, second, third, and fourth serpentine trailing edge cooling channels 38, 40, 42 and 43 may be in communication with one or more trailing edge exhaust orifices 50 for exhausting cooling fluids from the cooling channels 38, 40, 42 and 43. In one embodiment, the first, second, third, and fourth serpentine trailing edge cooling channels 38, 40, 42 and 43 may each share a single trailing edge exhaust orifice 50, may each include an independent trailing edge exhaust orifice 50, or may each be in communication with a plurality of trailing edge exhaust orifices 50. The exhaust orifices 50 may be sized based on anticipated flow rate, heat load in the trailing edge 20, cooling fluid pressure, and other factors.

The first, second, and third serpentine trailing edge cooling channels 38, 40, 42, and 43 may also each include inlets 52, 54, 56 and 57, respectively, for passing cooling fluids into the channels 38, 40, 42 and 43. The inlets 52, 54, 56 and 57 may have any size and configuration necessary to deliver an adequate cooling fluid supply to the channels 38, 40, 42 and 43. In at least one embodiment, the inlets 52, 54, 56 and 57 may be generally orthogonal to a longitudinal axis 58 of a cooling fluid supply channel 60.

Figure 4:
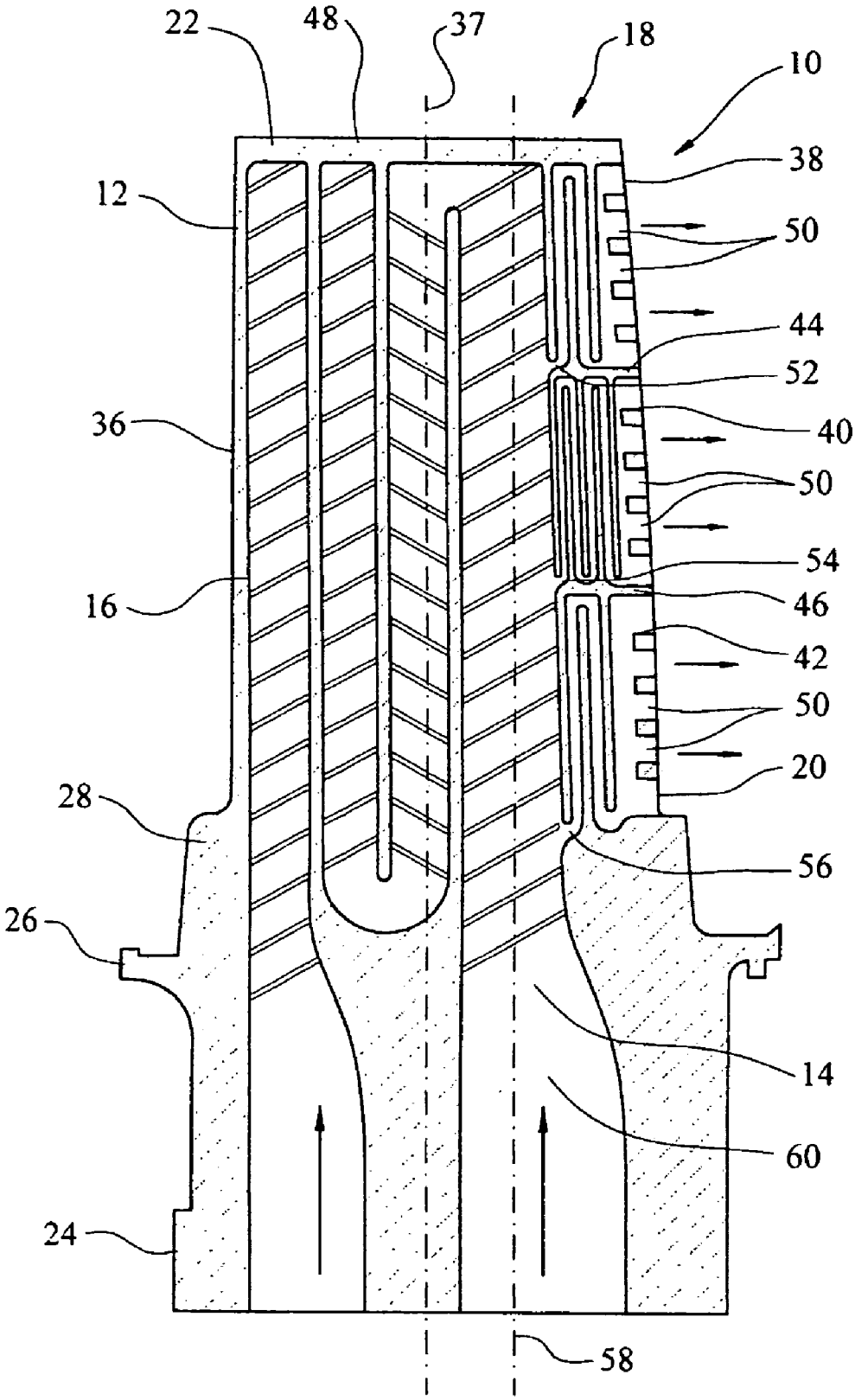
FIG. 4 is a cross-sectional view of an alternative embodiment of the turbine blade shown in FIG. 1 taken from the same perspective as line 2-2.
Figure 5:
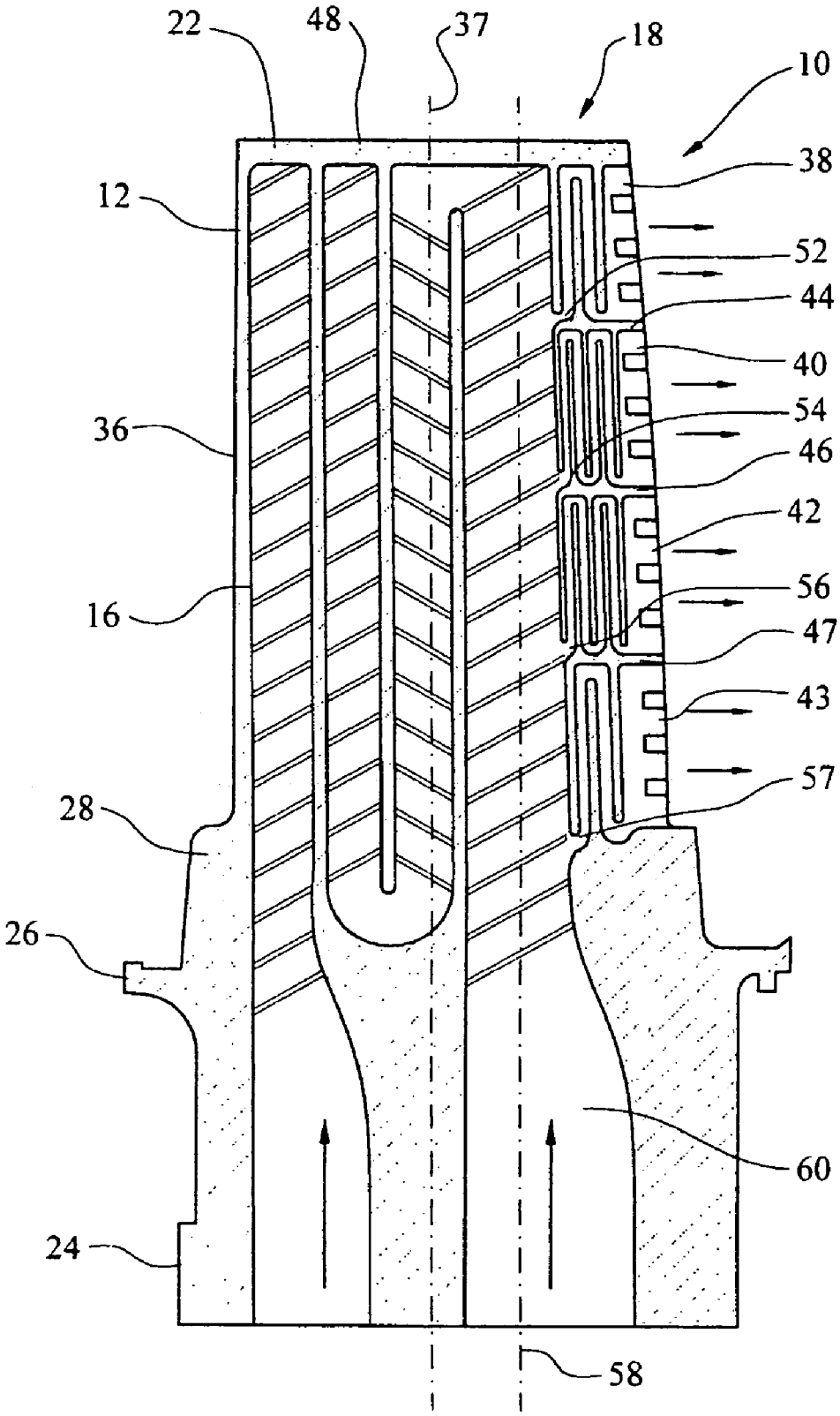
FIG. 5 is a cross-sectional view of an alternative embodiment of the turbine blade shown in FIG. 1 taken from the same perspective as line 2-2.

Each trailing edge cooling channel 38, 40, 42, and 43 may be formed from three pass or five pass serpentine channels, or a combination of both. Other embodiments may use serpentine channels having other numbers of passes. In at least one embodiment with three serpentine channels, as shown in FIG. 4, cooling channels 38 and 42 may be formed from triple pass serpentine cooling channels to better match the lower gas temperature profile and cooling channel 40 may be formed from a five pass serpentine cooling channel to achieve higher local cooling effectiveness. Similarly, in another embodiment with four serpentine channels, as shown in FIG. 5, cooling channels 38 and 43 may be formed from triple pass serpentine cooling channels to better match the lower gas temperature profile and cooling channels 40 and 42 may be formed from a five pass serpentine cooling channel to achieve higher local cooling effectiveness.

During operation, cooling fluids, which may be, but are not limited to, air, flow into the cooling system 10 from the root 24. At least a portion of the cooling fluids flow into the cavity 14 and into the cooling fluid supply channel 60. At least some of the cooling fluids flow through the inlets 52, 54, 56 and 57 and into the first, second, third and fourth serpentine trailing edge cooling channels 38, 40, 42 and 43. The cooling fluids enter the channels 38, 40, 42 and 43 in parallel and remove heat from the material forming the blade 22 proximate to the trailing edge 20. The cooling fluids flow through the serpentine trailing edge cooling channels 38, 40, 42 and 43 where the cooling fluids cool the material forming the blade 22. The cooling fluids are then exhausted through the trailing edge exhaust orifices 50 and out of the blade 22.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

at least one first serpentine trailing edge cooling channel that is at least a three pass channel positioned proximate to the trailing edge of the generally elongated blade for receiving cooling fluids from a cooling fluid source, passing the cooling fluids through the at least one first serpentine trailing edge cooling channel, and exhausting the cooling fluids through the trailing edge of the blade; and at least one second serpentine trailing edge cooling channel that is at least a three pass channel positioned proximate to the trailing edge of the generally elongated blade and in parallel with the at least one first serpentine trailing edge cooling channel for receiving cooling fluids from a cooling fluid source, passing the cooling fluids through the at least one second serpentine trailing edge cooling channel, and exhausting the cooling fluids through the trailing edge of the blade;

at least one third serpentine trailing edge cooling channel that is at least a three pass channel positioned proximate to the trailing edge of the generally elongated blade and parallel with the at least one first and second serpentine trailing edge cooling channels for receiving cooling fluids from a cooling fluid source, passing the cooling fluids through the at least one third serpentine trailing edge cooling channel, and exhausting the cooling fluids through the trailing edge of the blade;

wherein the at least one second serpentine trailing edge cooling channel is positioned between the at least one first and the at least one third serpentine trailing edge cooling channels and is a five pass serpentine cooling channel, and the at least one first and the at least one third serpentine trailing edge cooling channels are three pass serpentine cooling channels.

2. The turbine blade of claim 1, further comprising at least one fourth serpentine trailing edge cooling channel that is at least a three pass channel positioned proximate to the trailing edge of the generally elongated blade and parallel with the at least one first, second, and third serpentine trailing edge cooling channels for receiving cooling fluids from a cooling fluid source, passing the cooling fluids through the at least one fourth serpentine trailing edge cooling channel, and exhausting the cooling fluids through the trailing edge of the blade.

3. The turbine blade of claim 2, wherein the at least one third and fourth serpentine trailing edge cooling channels are five pass serpentine cooling channels.

4. The turbine blade of claim 2, wherein the at least one third and fourth serpentine trailing edge cooling channels include a plurality of trailing edge exhaust orifices.

5. The turbine blade of claim 2, wherein an inlet for the at least one third serpentine trailing edge cooling channel and wherein an inlet for the at least one fourth serpentine trailing edge cooling channel are generally orthogonal to a longitudinal axis of a cooling fluid supply channel.

6. The turbine blade of claim 1, wherein the at least one first serpentine trailing edge cooling channel and the at least one second serpentine trailing edge cooling channel include a plurality of trailing edge exhaust orifices.

7. The turbine blade of claim 1, wherein an inlet for the at least one first serpentine trailing edge cooling channel and an inlet for the at least one second serpentine trailing edge cooling channel are generally orthogonal to a longitudinal axis of a cooling fluid supply channel.

8. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

at least one first serpentine trailing edge cooling channel that is at least a three pass channel positioned proximate to the trailing edge of the generally elongated blade for receiving cooling fluids from a cooling fluid source, passing the cooling fluids through the at least one first serpentine trailing edge cooling channel, and exhausting the cooling fluids through the trailing edge of the blade; and at least one second serpentine trailing edge cooling channel that is at least a three pass channel positioned proximate to the trailing edge of the generally elongated blade and in parallel with the at least one first serpentine trailing edge cooling channel for receiving cooling fluids from a cooling fluid source, passing the cooling fluids through the at least one second serpentine trailing edge cooling channel, and exhausting the cooling fluids through the trailing edge of the blade;

at least one third serpentine trailing edge cooling channel that is at least a three pass channel positioned proximate to the trailing edge of the generally elongated blade and parallel with the at least one first and second serpentine trailing edge cooling channels for receiving cooling fluids from a cooling fluid source, passing the cooling fluids through the at least one third serpentine trailing edge cooling channel, and exhausting the cooling fluids through the trailing edge of the blade;

at least one fourth serpentine trailing edge cooling channel that is at least a three pass channel positioned proximate to the trailing edge of the generally elongated blade and parallel with the at least one first, second, and third serpentine trailing edge cooling channels for receiving cooling fluids from a cooling fluid source, passing the cooling fluids through the at least one fourth serpentine trailing edge cooling channel, and exhausting the cooling fluids through the trailing edge of the blade;

wherein the at least one second and the at least one third serpentine trailing edge cooling channels are positioned between the at least one first and the at least one fourth serpentine trailing edge cooling channels and are five pass serpentine cooling channels, and the at least one first and the at least one fourth serpentine trailing edge cooling channels are three pass serpentine cooling channels.

9. The turbine blade of claim 8, wherein the at least one second and third serpentine trailing edge cooling channels include a plurality of trailing edge exhaust orifices.

10. The turbine blade of claim 8, wherein an inlet for the at least one second serpentine trailing edge cooling channel and wherein an inlet for the at least one third serpentine trailing edge cooling channel are generally orthogonal to a longitudinal axis of a cooling fluid supply channel.

11. The turbine blade of claim 8, wherein the at least one first serpentine trailing edge cooling channel and the at least one fourth serpentine trailing edge cooling channel include a plurality of trailing edge exhaust orifices.

12. The turbine blade of claim 8, wherein an inlet for the at least one first serpentine trailing edge cooling channel and an inlet for the at least one fourth serpentine trailing edge cooling channel are generally orthogonal to a longitudinal axis of a cooling fluid supply channel.

13. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

at least one first serpentine trailing edge cooling channel that is at least a three pass channel positioned proximate to the trailing edge of the generally elongated blade for receiving cooling fluids from a cooling fluid source, passing the cooling fluids through the at least one first serpentine trailing edge cooling channel, and exhausting the cooling fluids through the trailing edge of the blade; and at least one second serpentine trailing edge cooling channel that is at least a three pass channel positioned proximate to the trailing edge of the generally elongated blade and in parallel with the at least one first serpentine trailing edge cooling channel for receiving cooling fluids from a cooling fluid source, passing the cooling fluids through the at least one second serpentine trailing edge cooling channel, and exhausting the cooling fluids through the trailing edge of the blade;

at least one third serpentine trailing edge cooling channel that is at least a three pass channel positioned proximate to the trailing edge of the generally elongated blade and parallel with the at least one first and second serpentine trailing edge cooling channels for receiving cooling fluids from a cooling fluid source, passing the cooling fluids through the at least one third serpentine trailing edge cooling channel, and exhausting the cooling fluids through the trailing edge of the blade;

wherein the at least one second serpentine trailing edge cooling channel is positioned between the at least one first and the at least one third serpentine trailing edge cooling channels and is at least a five pass serpentine cooling channel, and the at least one first and the at least one third serpentine trailing edge cooling channels are at least three pass serpentine cooling channels.

14. The turbine blade of claim 13, further comprising at least one fourth serpentine trailing edge cooling channel that is at least a three pass channel positioned proximate to the trailing edge of the generally elongated blade and parallel with the at least one first, second, and third serpentine trailing edge cooling channels such that the second and third serpentine trailing edge cooling channels are positioned between the first and fourth serpentine trailing edge cooling channels for receiving cooling fluids from a cooling fluid source, passing the cooling fluids through the at least one fourth serpentine trailing edge cooling channel, and exhausting the cooling fluids through the trailing edge of the blade.

15. The turbine blade of claim 14, wherein the at least one second and third serpentine trailing edge cooling channels are at least five pass serpentine cooling channels.

16. The turbine blade of claim 14, wherein the at least one second and third serpentine trailing edge cooling channels include a plurality of trailing edge exhaust orifices.

17. The turbine blade of claim 14, wherein an inlet for the at least one second serpentine trailing edge cooling channel and wherein an inlet for the at least one third serpentine trailing edge cooling channel are generally orthogonal to a longitudinal axis of a cooling fluid supply channel.

18. The turbine blade of claim 13, wherein the at least one first serpentine trailing edge cooling channel is at least a five pass serpentine cooling channel.

19. The turbine blade of claim 13, wherein the at least one fourth serpentine trailing edge cooling channel is at least a five pass serpentine cooling channel.

20. The turbine blade of claim 13, wherein the at least one first serpentine trailing edge cooling channel and the at least one fourth serpentine trailing edge cooling channel include a plurality of trailing edge exhaust orifices and wherein an inlet for the at least one first serpentine trailing edge cooling channel and an inlet for the at least one fourth serpentine trailing edge cooling channel are generally orthogonal to a longitudinal axis of a cooling fluid supply channel.

* * * * *